United States Patent [19]

Pratt

[11] Patent Number: 4,779,726

[45] Date of Patent: Oct. 25, 1988

[54] PACKAGING

[76] Inventor: Mykl S. Pratt, 202 Jersey Road, Woollahra, New South Wales, 2025, Australia

[21] Appl. No.: 75,611

[22] Filed: Jul. 20, 1987

[30] Foreign Application Priority Data

Feb. 25, 1987 [AU] Australia ..... PI0530/87

[51] Int. Cl.[4] ..... B65D 85/02

[52] U.S. Cl. ..... 206/315.9; 206/45.14; 206/303; 206/485; 229/40

[58] Field of Search ..... 229/40, 16 R; 206/315.9, 485, 303, 44 R, 45.14, 45.18

[56] References Cited

U.S. PATENT DOCUMENTS

| | | | |
|---|---|---|---|
| 2,515,026 | 7/1950 | Van Rosen | 206/485 |
| 3,123,204 | 3/1964 | Baker et al. | 206/315.9 |
| 3,259,234 | 7/1966 | Wood | 206/45.14 |
| 3,815,735 | 6/1974 | Cucuo | 206/315.9 |
| 3,987,893 | 10/1976 | Hanson | 206/315.9 |
| 4,134,493 | 1/1979 | Cech | 206/485 |

FOREIGN PATENT DOCUMENTS

| | | | |
|---|---|---|---|
| 2310602 | 9/1974 | Fed. Rep. of Germany | 206/45.14 |
| 825971 | 6/1957 | United Kingdom | 206/485 |
| 2160508 | 12/1985 | United Kingdom | 206/44 R |

*Primary Examiner*—Stephen Marcus
*Assistant Examiner*—Gary E. Elkins
*Attorney, Agent, or Firm*—Wolf, Greenfield & Sacks

[57] ABSTRACT

Packaging for spherical articles such as golf balls or basketballs, the packaging being formed from a blank of cardboard including two square panels, two rectangular panels and two triangular panels. The rectangular panels have circular recesses open to edges, the blank is folded so that the recesses lie in perpendicular intersecting planes so that the spherical article can be engaged and supported between the opposed recesses.

8 Claims, 4 Drawing Sheets

PACKAGING

This invention relates to packaging.

More particularly, the invention relates to packaging for a three dimensional article particularly but not exclusively a spherical article.

According to the present invention there is provided packaging for a three dimensional article, said packaging being formed from a blank of sheet material, said blank including at least first, second and third panels, the second panel being located between the first and third panels and being separated therefrom by first and second fold lines respectively, said fold lines being parallel, the first and third panels including first and second recesses which are open to respective edges thereof, and wherein said blank is folded about said fold lines so that the recesses are opposed to one another and said first and second panels lie in intersecting planes whereby the object can be engaged and supported between said opposed recesses.

The invention will now be further described with reference to the accompanying drawings, in which.

Figure 1:
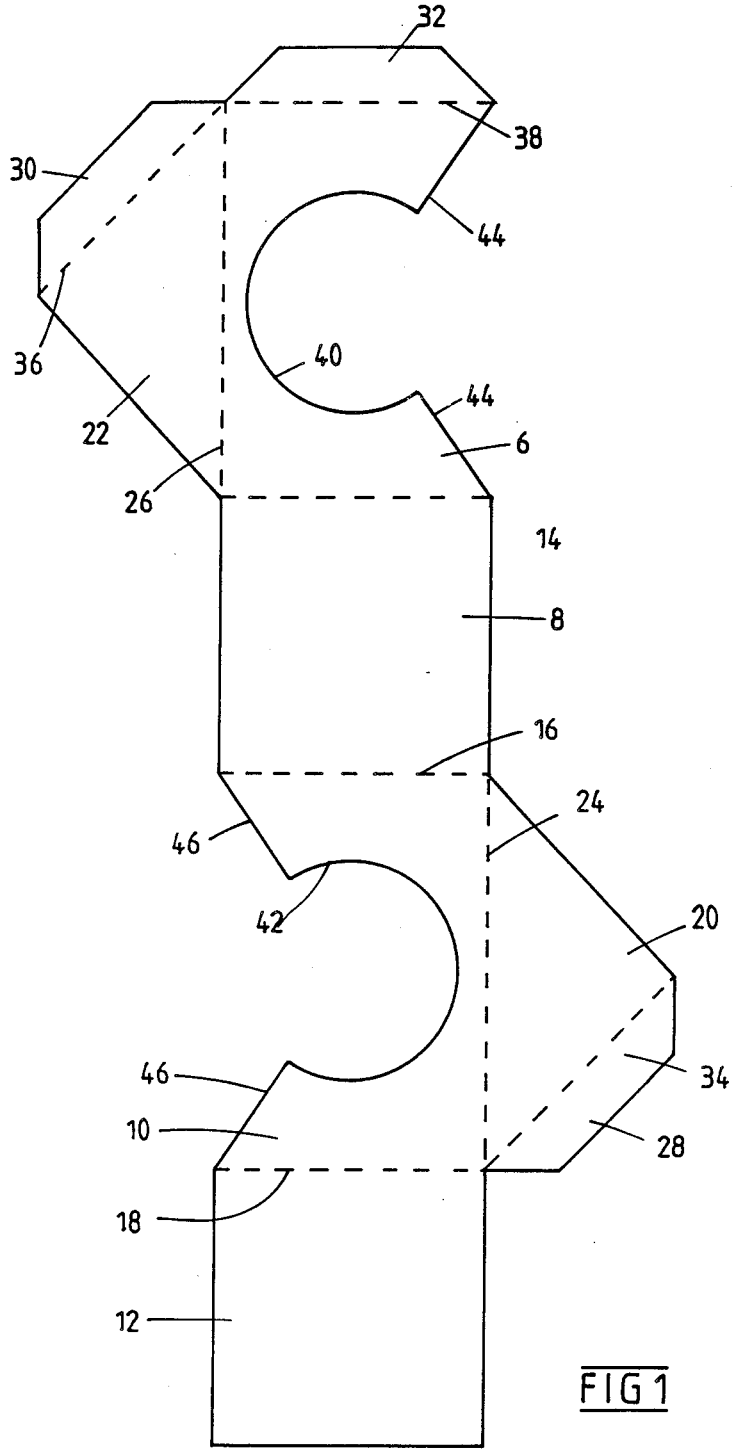
FIG. 1 is a plan view of a blank for forming a preferred form of packaging in accordance with the invention.
Figure 6:
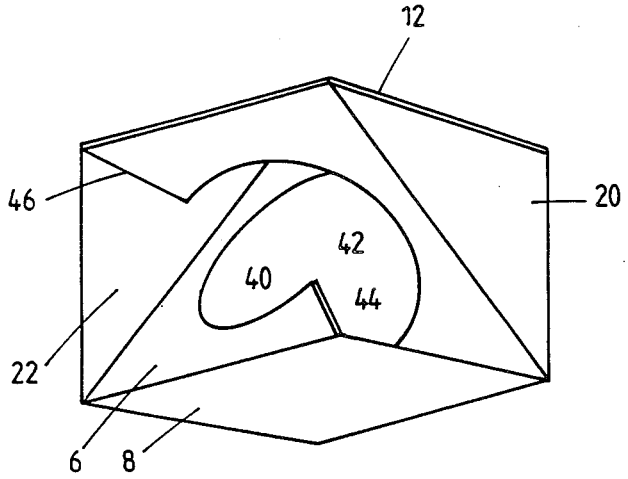
FIG. 6 is a perspective view of the completed packaging.

FIG. 6 shows packaging 2 constructed in accordance with the invention. It is especially suitable for packaging of spherical articles such as golf balls but clearly other spherial articles could be packed using the same form of packaging. Indeed, articles other than spherical articles may be packed. The packaging 2 is formed from a unitary blank 4 which is illustrated in FIG. 1. The blank 4 preferably comprises paper, cardboard or other material which is strong and light and is capable of folding without breaking.

The blank comprises a first panel 6, second panel 8, third panel 10, and fourth panel 12. The panels are separated by first, second and third fold lines, 14, 16 and 18. The second and fourth panels 8 and 12 are square whereas the first and third panels are rectangular, the longer side being substantially equal to the length of the diagonals of the square panels 8 and 12. The blank also includes first and second triangular panels 22 and 20 which are separated from the first and third panels 6 and 10 by fourth and fifth fold lines 26 and 24 respectively. The blank further includes first, second and third tabs 28, 30 and 32 separated from the panels 20, 22 and 6 by sixth, seventh and eighth fold lines 34, 36 and 38 respectively. The first and third panels 6 and 10 include part circular recesses 40 and 42 which are opened to opposite edges of the panels at diagonal shoulders 44 and 46 respectively. The packaging 2 is formed by folding the blank about the various fold lines and gluing the tabs in a manner which will be described hereinafter.

Figure 2:
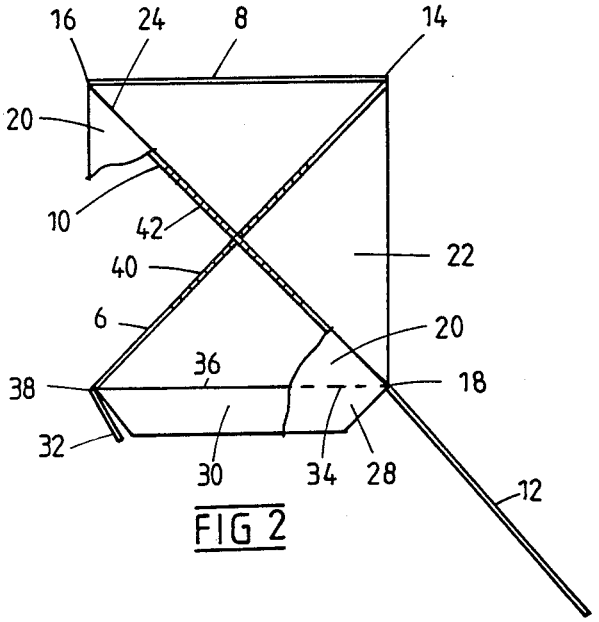
FIG. 2 shows the blank in a partly folded condition.
Figure 3:
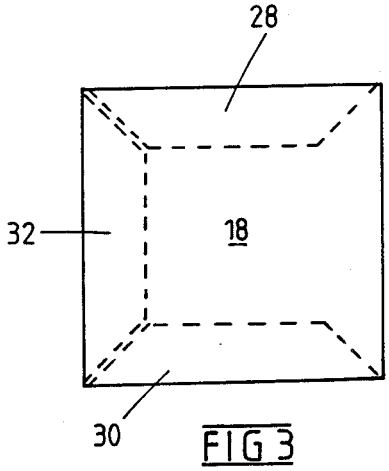
FIG. 3 is an underside view of the completed packaging.
Figure 4:
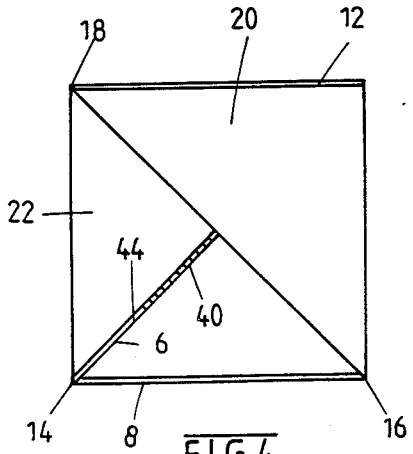
FIG. 4 is a view from one side of the completed packaging.
Figure 5:
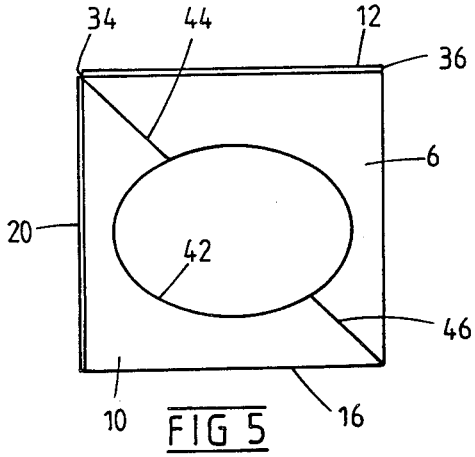
FIG. 5 is a view from another side of the completed packaging.

The packaging may be formed by folding the first and third panels 6 and 8 about the fold lines 14 and 16 so that the first and third panels move into the plane of the page (as seen in FIG. 1). All of the other panels and tabs are folded about their adjacent fold lines such that they move out of the plane of the page. The panels 6 and 10 are rotated to a position in which they lie in perpendicular intersecting planes, as shown in FIG. 2. In this condition the recesses 40 and 42 are mutually opposed. In moving into this position it is necessary that one or more of the panels 6, 8 and 10 resiliently deforms in order to permit the shoulders 44 and 46 to pass one another in order to arrive at the required disposition of the panels. In FIG. 2 the first triangular panel 20 is partly broken away to more clearly illustrate the relative positions of the panels 6 and 10. The remaining panels and tabs are then folded about their respective adjacent fold lines. The triangular panels 20 and 22 will be located at opposite sides of the packaging and the tabs 28, 30 and 32 will all lie inwardly adjacent to the fourth panel 12. Glue or adhesive can be used to glue or bond the tabs to the fourth panel 12 so as to complete the packaging. As will be apparent from FIGS. 5 and 6 recesses 40 and 42 are opposed so that they can engage and support an article (not shown) such as a golf ball or other spherical article therebetween. Because of the geometry of the arrangement, the article is held captive between the opposed recesses and is not contacted by any of the other panels.

Many modifications will be apparent to those skilled in the art. For instance, the shapes of the recesses 40 and 42 may be altered so as to accommodate articles of a different shape. In the illustrated arrangement, the external dimensions of the packaging are such that it is cubic but it will be appreciated that other shapes, for instance a cuboid shape could be made using the same techniques.

The packaging of the invention has a number of advantages. First, it can be made from blank. Second, the blank can be printed on both sides which are visible to an observer. Third, the article can be inserted into the completed blank by resilient deflection of the panels or alternatively the blank can be folded about the article.

Figure 7:
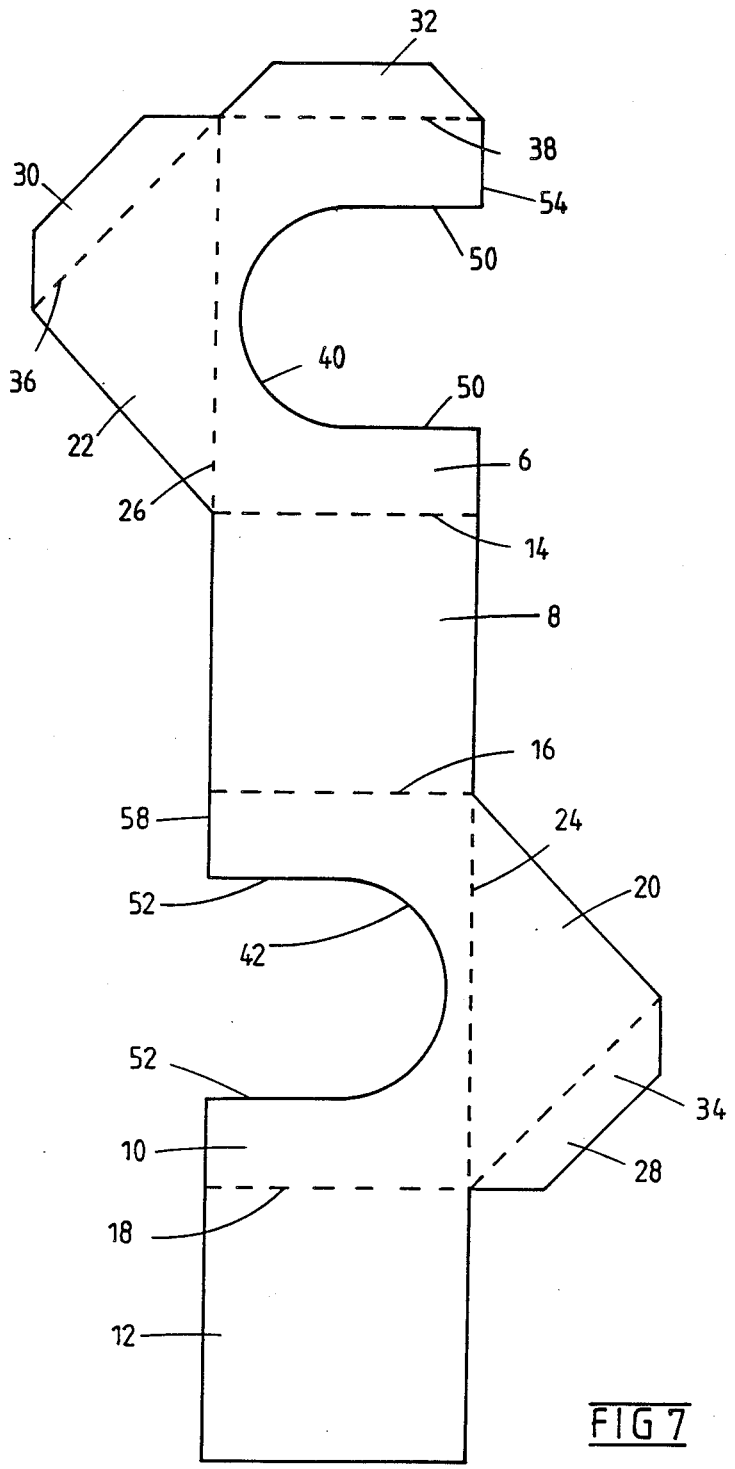
FIG. 7 shows a blank of a modified form of the invention.

FIG. 7 shows a modified form of blank. In this arrangement the diagonal shoulders 44 and 46 are eliminated and straight portions 50 and 52 extend from the recesses 40 and 42 to edges 54 and 58 which are parallel to the edges of the second and fourth panels 8 and 12. The blank is erected in an analogous way to that described previously.

A handle (not shown) may be provided on any one of the panels but preferably be second or fourth panels 8 and 12. For larger packaging arrangements, such as for packaging of basketballs, the handle may be integrally formed with the panels.

Many modifications will be apparent to those skilled in the art without departing from the spirit and scope of the invention which includes every novel feature or novel combinaton of features herein disclosed.

I claim:

1. A blank for forming packaging for a three dimensional article said blank including:

a first rectangular panel, a first square panel joined to one of the shorter sides of the first rectangular panel by a first fold line, a second rectangular panel joined to said first square panel by a second fold line which is parallel to said first fold line, a second square panel joined to said second rectangular panel by a third fold line which is parallel to said second fold line, a first triangular panel joined at one side thereof to one of the longer sides of the first rectangular panel by a fourth fold line, the other two sides of the first triangular panel being equal in length to the length of a side of the first square panel, a first recess formed in the first rectangular panel and opening to the other longer side of the first rectangular panel, a second triangular panel joined at one side thereof to one of the longer sides of the second rectangular panel by a fifth fold line, the other two sides of the second triangular panel being equal in length to the length of a side of the first square panel, and a second recess formed in the second rectangular panel and opening to the other longer side of the second rectangular panel.

2. A blank as claimed in claim 1 including tabs which in use interconnect at least the first and second triangular panels to the fourth panel.

3. A blank as claimed in claim 2 wherein there are first, second and third tabs joined to the first and second triangular panels and first panel by sixth, seventh and eighth fold lines respectively.

4. A blank as claimed in claim 3 wherein the fourth, seventh and eighth fold lines intersect at one of the corners of the first rectangular panel, and wherein the third, fifth and sixth fold lines intersect at one of the corners of the second rectangular panel.

5. Packaging for a three dimensional article, said packing being formed from a blank of sheet material, said blank including:

a first rectangular panel, a first square panel joined to one of the shorter sides of the first rectangular panel by a first fold line, a second rectangular panel joined to said first square panel by a second fold line which is parallel to said first fold line, a second square panel joined to said second rectangular panel by a third fold line which is parallel to said second fold line, a first triangular panel joined at one side thereof to one of the longer sides of the first rectangular panel by a fourth fold line, the other two sides of the first triangular panel being equal in length to the length of a side of the first square panel, a first recess formed in the first rectangular panel and opening to the other longer side of the first rectangular panel, a second triangular panel joined at one side thereof to one of the longer sides of the second rectangular panel by a fifth fold line, the other two sides of the second triangular panel being equal in length to the length of a side of the first square panel, and a second recess formed in the second rectangular panel and opening to the other longer side of the second rectangular panel; and wherein the blank is folded about said fold lines such that the square panels and the triangular panels be on surfaces of a cube and said rectangular panels extend diagonally across the cube with said first and second recesses being opposed to one another for receipt of an article.

6. Packaging as claimed in claim 5 wherein the blank includes tabs which interconnect at least the first and second triangular panels to the fourth panels.

7. Packaging as claimed in claim 6 wherein there are first, second and third tabs joined to the first and second triangular panels and first panel by sixth, seventh and eighth fold lines respectively.

8. Packaging as claimed in claim 7 wherein the fourth, seventh and eighth fold lines intersect at one of the corners of the first rectangular panel, and wherein the third, fifth and sixth fold lines intersect at one of the corners of the second rectangular panel.

* * * * *